United States Patent [19]

Steele

[11] 4,339,988

[45] Jul. 20, 1982

[54] FREE ECCENTRIC RECIPROCATING PISTON DEVICE

[75] Inventor: Duane F. Steele, Dundee, Mich.

[73] Assignee: Ford Motor Company, Dearborn, Mich.

[21] Appl. No.: 138,387

[22] Filed: Apr. 8, 1980

[51] Int. Cl.[3] ..... F01B 1/06

[52] U.S. Cl. ..... 91/493

[58] Field of Search ..... 91/493, 495; 417/273, 417/534; 123/55 A, 55 AA

[56] References Cited

U.S. PATENT DOCUMENTS 3,977,303 8/1976 Baker ..... 91/493

FOREIGN PATENT DOCUMENTS 2427855 1/1975 Fed. Rep. of Germany ..... 91/493

*Primary Examiner*—Michael Koczo

*Attorney, Agent, or Firm*—Frank G. McKenzie; Donald J. Harrington

[57] ABSTRACT

A one-piece cylinder block has a central opening providing surfaces on which a crankshaft is journalled and has radially-directed cylinder bores in axially offset pairs extending outwardly from the axis of the crankshaft. A crank pin is formed on the crankshaft eccentric of its central axis and furnishes an axial surface upon which a free eccentric cluster is journalled. The eccentric cluster includes cylindrical surfaces journalled on the crank pin surface spaced axially in alignment with the axis of the cylinder bore pairs, each having its central axis positioned eccentrically of the crank pin axis. Each cylindrical surface of the eccentric cluster has a piston yoke journalled thereon providing a radially directed and diametrically opposed arms, on the outer extremities of which a piston surface is mounted for reciprocating motion within the cylinder bores. The device can be used as a compressor pump in which case the crankshaft is driven in rotation thereby causing the pistons to reciprocate in the cylinders. Alternatively, the device can be operated as an engine wherein the piston motion drives the crankshaft in rotation. The one-piece housing is sealed at the radial ends of the cylinder bores by cylinder heads and at each axial end by end cover plates. Suitable passages are formed within the housing to carry fluid to and from the cylinder valves, which control the flow of fluid into and out of the cylinders. The device can be operated with any number of cylinder bore pairs that is a multiple of two provided the free eccentric cluster elements are accordingly increased in number and arranged on the crankpin surface in alignment with each of the cylinder bore pairs.

3 Claims, 4 Drawing Figures

FREE ECCENTRIC RECIPROCATING PISTON DEVICE

BACKGROUND OF THE INVENTION

1. Field of the Invention

The present invention relates to a radial piston device operable as a compressor, pump, engine, etc. and more particularly to such a device wherein the pistons are mounted on a rotating eccentric that rotates eccentrically of a crankshaft.

2. Description of the Prior Art

A four cylinder, four cycle engine operating with a free eccentric mounted on a crankpin eccentrically of the axis of a crankshaft was disclosed in "The Proceedings of the Institution of Mechanical Engineers", 1974, Vol. 188 38/174, pages 505–517. In that article the engine was described as having a cylinder block constructed of several discrete elements bolted together in a sealed arrangement. The need for the cylinder block to have been constructed of several parts was necessitated by the need to install the free eccentric assembly, the piston yokes and the pistons as a single unit. The segmented cylinder block was then assembled and joined around the dynamic elements. In addition, this article described the crankshaft as being comprised of several elements joined at positioning recesses and secured by an axially extending tension bolt, which, upon being drawn up with a nut, joined the several components rigidly together. The device described was intended for use as an internal combustion engine and included a novel rotary valve that allowed a single port in the cylinder wall to carry the combustible mixture to the cylinders and the exhaust gas from the cylinders.

An obvious difficulty associated with the engine block formed from several pieces is the need to provide a gas tight seal. This is a particularly difficult problem given the extremely high gas pressure that is developed within the cylinder. Although this problem was recognized when the article was published, the technical difficulty associated with overcoming the problem was apparently resolved by providing a sufficiently tight mechanical seal at the parting line being between the engine block segments. It would be preferable, instead, for the device to have a one-piece engine block so that the difficulties associated with having several long mechanical seals between the engine block segments can be avoided.

SUMMARY OF THE INVENTION

It is an objective of this invention to provide a free eccentric assembly for use with a reciprocating radial piston device such that it can be assembled easily and quickly in a one-piece cylinder block. This result has been realized through the use of a one or two piece crankshaft having an eccentric crankpin upon which an eccentric is journalled and installed in the cylinder block from one axial end. Piston yokes are mounted on the surfaces of the eccentric and the crankshaft is positioned within the central cavity of the cylinder block. The pistons are installed on the outer radial ends of the piston yoke arms and are mechanically joined to the piston arms with access from the outer radial ends of the cylinder block. The device can be adapted for operation with a plurality of cylinders whose number is a multiple of four. The one piece housing has a central axially directed opening having support surfaces provided on which a crankshaft is mounted for rotation about its central axis. Pairs of radially directed cylinder bores are formed in the housing and are spaced axially along its length. A crankshaft has a crankpin offset eccentrically from its axis, which is parallel to the crankshaft axis. The crankpin surface is cylindrical and has needle bearings mounted thereon. A free eccentric is installed over the needle bearings.

The eccentric provides several eccentric cylinders corresponding in number to the cylinder bore pairs and is spaced axially along the crankshaft in alignment with the axis of the several bore pairs. One piston yoke mounted on the bearings on each outer surface of the eccentric furnishes radial arms that extend outwardly within the cylinder bores. The pistons are mounted on the yoke arms, access being gained through the outer radial ends of the cylinders, which are closed off by cylinder heads that are bolted to the housing.

The crankshaft has a stub end portion mounted on the axial end of the crankpin and adapted to seat within the central opening of the housing in bearings provided for its support. Each axial end of the central housing opening is sealed off by an end cover plate. The housing has internal passages that function as conduits through which low pressure fluid is admitted to the cylinders and compressed fluid is carried from the cylinders to a fluid circuit.

DESCRIPTION OF THE PREFERRED EMBODIMENT

Figure 1:
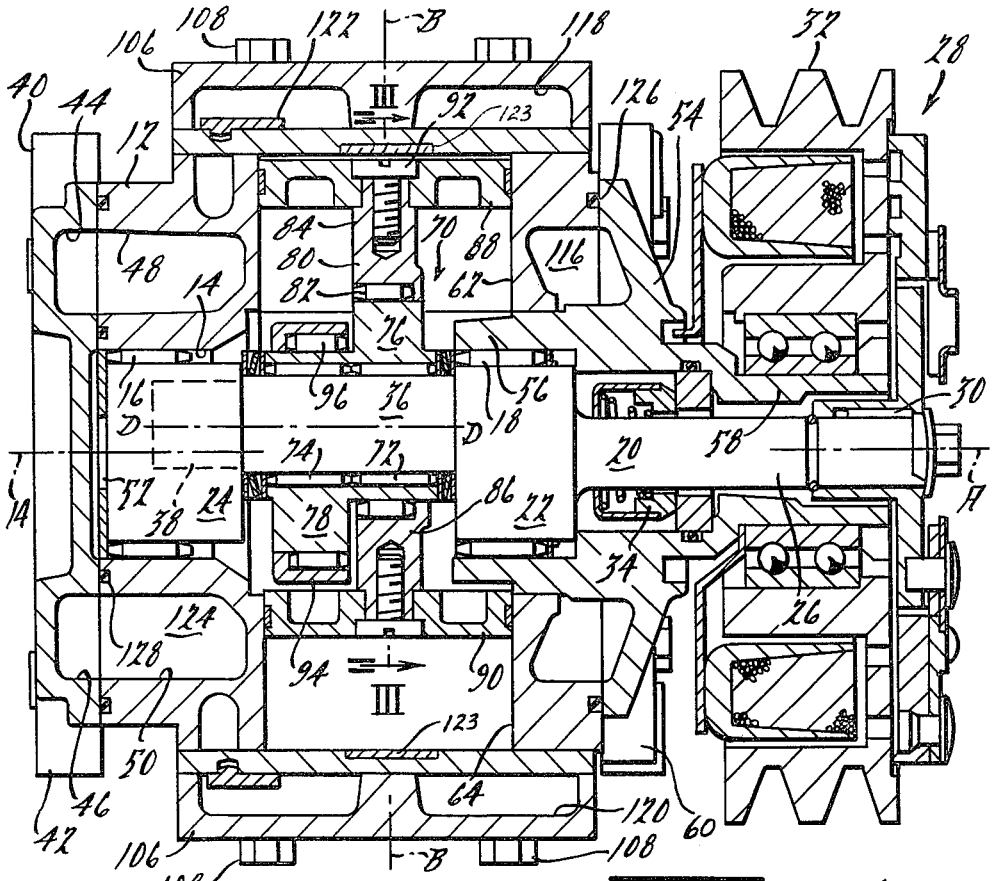
FIG. 1 is a cross-section of a four cylinder radial piston device according to this invention taken through a plane that includes the axis of one cylinder bore pair.

Referring first to FIG. 1, a cylinder block formed of a one-piece housing 12 has a central opening 14 extending along the axis of the device and providing cylindrical surfaces into which the needle bearings 16, 18 are fitted.

A crankshaft 20 has cylindrical portions 22, 24 journalled in the bearings 16, 18 that provide support for the crankshaft and the moveable parts mounted thereon and permit rotation about the central longitudinal axis A—A. The crankshaft 20 includes an end portion 26 to which a magnetic clutch, shown generally at 28, is joined at the splines 30. The magnetic clutch can be driven by a prime mover operating to drive a belt that engages the pulley 32 when the device is operated as a compressor or pump. When the device is operating as an engine or prime mover, the crankshaft 20 can be joined to the driven device at the splines 30. The shaft seal 34 is mounted at the end portion 26 to prevent outward flow of hydraulic fluid from the device. The crankshaft 20 includes a crankpin portion 36 that can be formed integrally with the cylindrical portion 22 or as a separate piece. In either case, the crankpin provides a cylindrical surface having a central axis D—D that is eccentric of and parallel to the axis A—A and extends axially between the cylindrical crankshaft portions 22, 24. The cylindrical portion 24 is mounted on a portion 38 of the crankpin 36 and is arranged so that its axis is collinear with the axis A—A.

A rear cover plate 40 is joined mechanically to the housing 12 and provides outstanding lug portions 42 whereby the device can be rigidly mounted on a supporting structure. The rear cover plate 40 has internal duct portions 44, 46 that align with complimentary duct portions 48, 50 of the housing 12. These ducts provide a means for internal flow of fluid to and from the cylinder bores. A thrust washer 52 is inserted between the inner face of the rear cover plate 40 and the end face of the cylinder portion 24.

At the axially opposite end of the device a front cover plate 54 provides an annular flange portion 56 that furnishes a surface upon which the outer race of the bearing 18 is supported and an outwardly extending flange 58 upon which the magnetic clutch pulley 32 or a similar device can be mounted and supported. The cover plate 54 is mechanically attached to the housing 12 and similarly provides outstanding lugs 60 whereby the front end of the device can be secured to a supporting structure.

Figure 2:
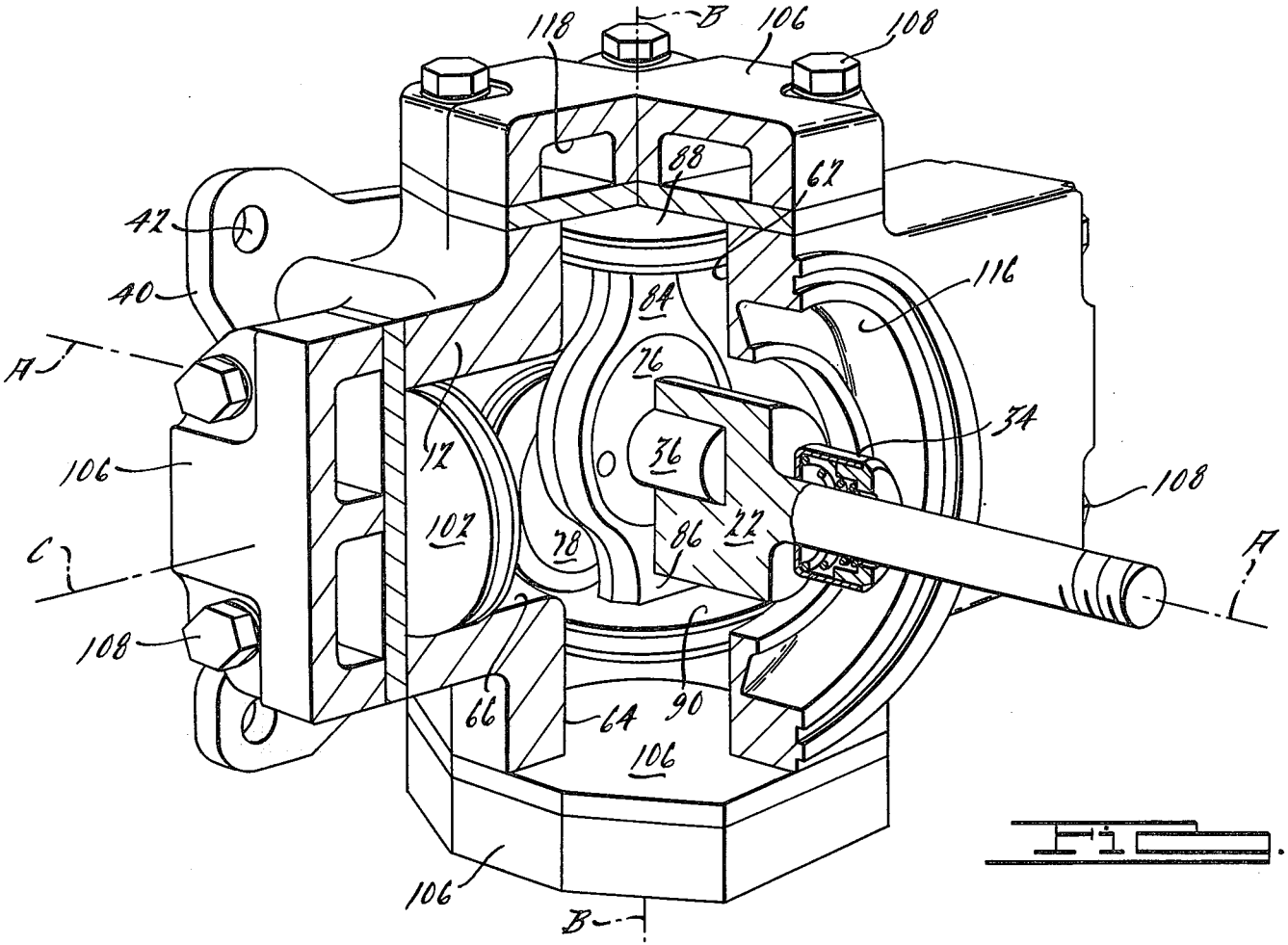
FIG. 2 is an isometric view of the device shown in FIG. 1 but having a quadrant section removed to expose the eccentric, yokes and pistons working within the cylinders.
Figure 4:
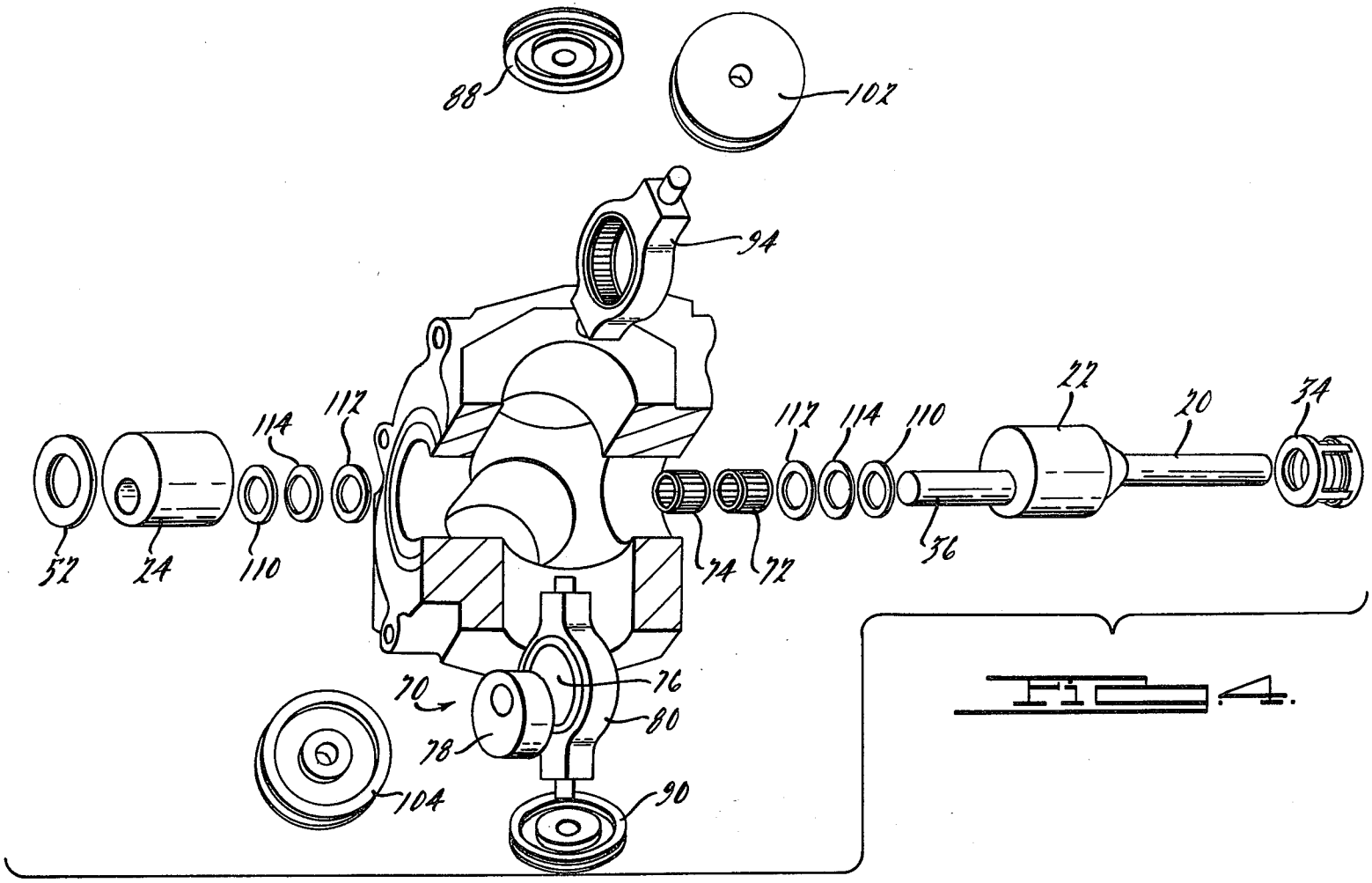
FIG. 4 is a view of the device showing a quadrant of the one-piece housing removed to show the relative positions of the internal moving parts, which are illustrated in the order of their assembly but in spaced relationship.

The housing 12, as shown in FIGS. 1 and 2, has a first pair of radially directed cylinder bores 62, 64 having a collinear axis B—B that is perpendicular to and intersects the axis A—A. The housing also has a second pair of radially directed cylinder bores 66, 68 having a collinear axis C—C that is axially displaced from the axis B—B and is mutually perpendicular to the axes A—A and B—B and intersects the axis A—A.

Figure 3:
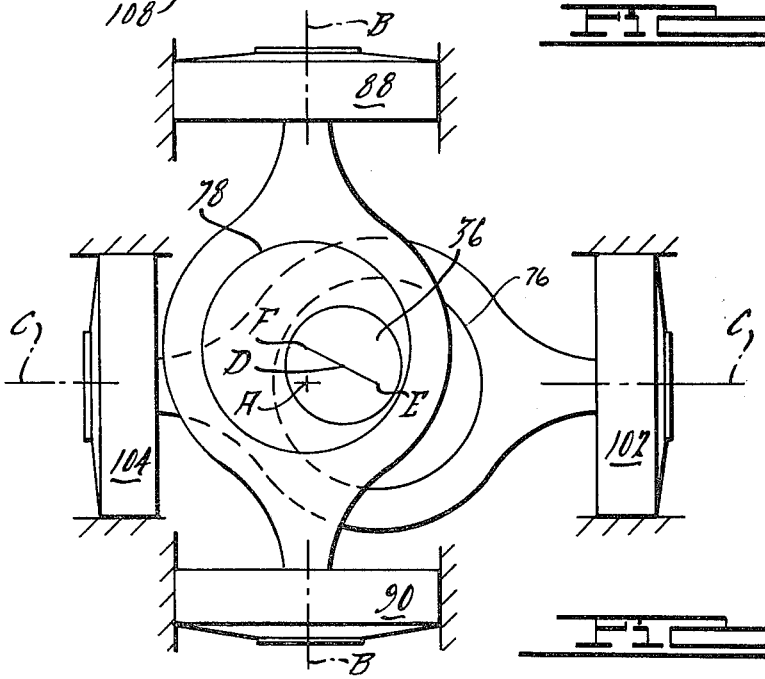
FIG. 3 is a sketch of the device viewed axially at section 3—3 of FIG. 1 showing the relative positions of the crankshaft axis, A—A; the cylinder bore axes, B—B and C—C; the crankpin axis, D—D; and the axes of the first and second cylindrical portions of the eccentric, E—E and F—F.

An eccentric cluster 70 is journalled by the needle bearings 72, 74 on the cylindrical surface of the crankpin 36. The crankpin has an axis that is parallel to axis A—A but is radially displaced therefrom. The eccentric includes a first circular cylindrical surface portion 76 having a central axis that is parallel to and eccentric of the axes of the crankshaft 20 and the crankpin 36. The relative positions of the various axes viewed from an axial end is illustrated in the sketch shown in FIG. 3. In FIG. 3, the axis of the crankshaft 20 is shown centrally located at point A. The axis of the crankpin 36 is shown at point D located radially eccentric of point A. The radially directed axis of the first pair of cylinder bores is shown as axis B—B and the axis of the second pair of cylinder bores is shown at axis C—C. The first circular cylindrical surface 76 of the eccentric 70 has its axis E—E shown at point E, and a second circular cylindrical surface 78 of the eccentric 70 has its axis F—F shown at point F. The points A, D, E and F represent end views of parallel axes A—A, D—D, E—E, F—F. The axis E—E is seen to intersect the axis C—C and in operation point E is required to move along the line C—C. The axis F—F is seen to intersect the axis B—B and in operation the point F is required to move along the axis B—B. The line E—F containing the centers E, F of the first and second circular cylindrical surfaces 76, 78 is a diameter of the crankpin 36. The first cylindrical surface 76 of the eccentric is located axially in substantial alignment with the axis C—C of the first pair of cylindrical bores 62, 64. The second cylindrical surface 78 of the eccentric is located axially in substantial alignment with the axis B—B of the second pair of cylindrical bores 66, 68.

Referring again to FIGS. 1 and 2, a first piston yoke 80 is journalled by the needle bearings 82 on the cylindrical surface of the portion 76 of the eccentric 70. The piston yoke 80 has two radially extending arms 84, 86 that extend outwardly within the cylinder bores 62, 64. Pistons 88, 90 are mounted on and joined mechanically to the outer ends of the arms 84, 86 by the attachment bolts 92. The pistons are fitted within the cylinder bores 62, 64 for reciprocal radial motion therein.

The second cylindrical portion 76 of the eccentric 70 has a second piston yoke 94 journalled thereon by the needle bearings 96. The piston yoke 94 has two radially extending arms 98, 100 that extend outward from the cylindrical surface portion 78 within the cylinder bores 66, 68. Pistons 102, 104 are mounted on and mechanically attached to the radially outermost end of the arms 98, 100 for reciprocal motion within the cylinder bores 66, 68. Each of the cylinder bores is closed off by a cylinder head 106 that is fixed to the housing 12 by the head bolts 108.

At each axial end of the eccentric 70 a washer pack including two flat washers (110, 112) with a curved washer (114) therebetween is interposed between the axial end face of the eccentric and the adjacent faces of the cylindrical portions 22, 24.

At the front end of the device an annular inlet chamber 116 carries a refrigerant that has been expanded through a throttle valve and heated in an evaporator of an air conditioning system (not shown). The chamber communicates with each cylinder head in which an inlet chamber 118, 120 has been formed. A suction reed 123 deflects during the suction stroke and admits the refrigerant to the cylinders 62, 64, 66, and 68. During the exhaust stroke, the suction reed valve 123 is closed and an exhaust reed valve 122 opened, whereby the pressurized refrigerant in a vapor state is carried through the porting into the annular exhaust chamber 124 that is formed by the duct portions 44, 46, 48, 50 of the rear cover plate 40 and housing 12. From the exhaust chamber 124 the refrigerant is carried to the condenser of the air conditioning system wherein the refrigerant is chilled and experiences a phase change to the liquid state.

The device is assembled with the rear cover 40 and the front cover 54 removed. A combination of parts is formed that includes the crankshaft 20, the crankpin 36, onto which the flat washers 110, 112 and the curved washer 114 are mounted, and the needle bearings 72, 74. This subassembly is installed axially from one end of the central opening 14. The eccentric 70 having the first piston yoke 80 mounted on the first cylindrical surface 76 is admitted to the central opening through either of the cylinder bores. The bearings 72, 74 are fitted within the bores of the eccentric and the second piston yoke 94, into which the bearing 96 has been fitted, is mounted on the second circular cylindrical eccentric portion 78. The piston yokes 80, 94 are positioned substantially in alignment with the axes B—B and C—C, respectively. The washers 110, 112, 114 are mounted on the protruding end portion of the crankpin 36. The cylindrical stub portion 24 of the crankshaft is mounted on the crankpin and the thrust washer 52 is finally fitted over the crankpin stub 24. The pistons 88–91 are fitted over the ends of the piston yoke arms 84, 86, 98, and 100 and are mechanically attached thereto by the bolts 92. The forward O-rings 126 are seated in the annular grooves provided for them in the housing 12. The shaft seal assembly 34 is installed over the crankshaft 20 and the front cover 54 is mounted on the front face of the housing 12. Similarly, the rear O-ring 128 is seated in its recess in the housing and the rear cover plate is mechanically secured to the rear face of the housing 12. The cylinder head assemblies, which include the reed valves 122, 123, the reed retainer, and the reed plate, are secured at the radial ends of the cylinder bores 62, 64, 66, and 68 by the attachment bolts 108 that are drawn up in the tapped holes in the housing 12.

The device can be adapted to operate with any number of pistons provided the number is a multiple of four. If, for example, eight cylinders were used, the eccentric would have two additional cylindrical lobes spaced axially along the axis A—A, each lobe being aligned with the radial directed axis of each cylinder bore pair. Two additional piston yokes would be mounted on bearings on the outer surfaces or lobes of the eccentric and two additional pistons would be mounted on the radial ends of the additional piston yokes.

Having thus described a preferred embodiment of my invention, what I claim and desire to secure by U.S. Letters Patent is:

1. A reciprocating radial piston device comprising:

a housing formed of a single piece having an axially directed opening, a first pair of radially directed coaxial cylinder bores, a second pair of radially directed coaxial cylinder bores whose axis is axially displaced from and perpendicular to the axis of the first pair of cylinder bores;

a crankshaft journalled in the opening of the housing for rotation about its longitudinal axis;

a cylindrical crankpin mounted on said crankshaft and extending within the central opening having an axis directed parallel to the crankshaft axis and displaced radially therefrom;

an eccentric journalled on said crankpin including:

a first cylindrical surface whose axis is parallel to and eccentric of the axes of said crankshaft and said crankpin and intersects the axis of the first pair of cylinder bores, and;

a second cylindrical surface axially displaced from the first cylindrical surface whose axis is parallel to and eccentric of the axis of said crankshaft and said crankpin and intersects the axis of the second pair of cylindrical bores, the centers of the circles of the first and second cylindrical surfaces being located on a diameter of the crankpin equidistant from and on opposite sides of the crankpin axis;

first and second piston yokes journalled on the first and second cylindrical surfaces respectively of the eccentric assembly extending radially therefrom in substantial alignment respectively with the axes of the first and second pairs of cylindrical bores;

a first pair of pistons mounted on diametrically opposite ends of said first piston yoke for reciprocating movement within the first pair of cylinder bores;

a second pair of pistons mounted on diametrically opposite ends of said second piston yoke for reciprocating movement within the second pair of cylinder bores;

cylinder heads mounted on said housing at the outer end of the cylinder bores to seal the cylinder bores;

porting means formed within said housing for carrying fluid to and from the cylinder bores;

valve means for controlling the entry of fluid into and its exit from the cylinder bores;

end cover plates mounted on said housing for sealing the central opening;

whereby the pistons reciprocate within the cylinder bores to compress the fluid as the crankshaft is driven in rotation.

2. The devices as set forth in claim 1 wherein the crankpin axis is eccentric of the crankshaft axes a predetermined distance and the centers of the circles of the first and second cylindrical surfaces are distant from the crankpin axis the predetermined distance.

3. The device as set forth in claim 1 wherein said housing has a plurality of cylinder bore pairs that is in number any multiple of the number two, the axis of each cylinder bore pair being axially spaced from the other cylinder bore pairs;

said eccentric has a plurality of cylindrical surface pairs that is equal in number to one-half the number of cylinder bore pairs, each cylindrical surface is spaced axially in alignment with the cylinder bore pairs and has an axis that is parallel to and eccentric of the axes of said crankshaft and said crankpin and intersects the axis of the cylinder bore pair with which it is axially aligned, the centers of the circles of each cylindrical surface pair being located on a diameter of the crankpin equidistant from and on opposite sides of the crankpin axis, each crankpin diameter being circumferentially spaced from other crankpin diameters by an amount that is equal to the circumferential spacing of the cylinder bore axes; and the piston yokes are in number equal to the number of cylinder bore pairs, each is journalled on the cylindrical surfaces and extends radially therefrom in substantial alignment with the axes of the cylinder bore pairs with which they are respectively aligned.

* * * * *